United States Patent [19]

Fair et al.

[11] Patent Number: 4,528,077

[45] Date of Patent: Jul. 9, 1985

[54] MEMBRANE ELECTROLYTIC CELL FOR MINIMIZING HYPOCHLORITE AND CHLORATE FORMATION

[75] Inventors: David L. Fair, Chattanooga; David D. Justice; Kenneth E. Woodard, Jr., both of Cleveland, all of Tenn.

[73] Assignee: Olin Corporation, Cheshire, Conn.

[21] Appl. No.: 394,964

[22] Filed: Jul. 2, 1982

[51] Int. Cl.[3] ..... C25B 1/26; C25B 1/34; C25B 11/03; C25B 11/10

[52] U.S. Cl. ..... 204/95; 204/98; 204/128; 204/283; 204/290 F; 204/296

[58] Field of Search ..... 204/290 F, 252, 296, 204/290 R, 293, 95, 98, 128, 282–283; 521/27

[56] References Cited

U.S. PATENT DOCUMENTS

| | | | |
|---|---|---|---|
| 4,005,003 | 1/1977 | Popplewell et al. | 204/290 F |
| 4,090,931 | 5/1978 | Motani et al. | 204/98 |
| 4,100,050 | 7/1978 | Cook, Jr. et al. | 204/252 |
| 4,120,772 | 10/1978 | Kadija | 204/252 |
| 4,176,215 | 11/1979 | Molnar et al. | 521/27 |
| 4,177,116 | 12/1979 | DeNora et al. | 204/98 |
| 4,217,199 | 8/1980 | Cunningham | 204/256 |
| 4,230,544 | 10/1980 | McRae | 204/98 |
| 4,240,895 | 12/1980 | Gray | 204/290 |

*Primary Examiner*—Donald R. Valentine
*Attorney, Agent, or Firm*—James B. Haglind; Donald F. Clements

[57] ABSTRACT

An electrolytic cell for the electrolysis of an alkali metal chloride brine is comprised of an anode compartment and a cathode compartment separated by a cation exchange membrane. The anode is comprised of an unflattened expanded structure of a valve metal selected from the group consisting of titanium, tantalum, niobium, and alloys thereof. At least one side of the anode has as the electrochemically active surface an electrodeposited layer of a valve metal oxide. A plurality of cracks traverse the electrodeposited layer and a coating of a platinum metal group oxide covers the electrodeposited layer and substantially fills the cracks. The cationic exchange membrane is comprised of a laminated structure having a first surface adapted to contact an anolyte in which the ion exchange groups are predominately sulfonic acid groups. The first surface is also in contact with the electrochemically active surface of the anode. A second surface of the cation exchange membrane, adapted to contact a catholyte, has ion exchange groups which are predominately carboxylic acid groups. The cathode positioned in the cathode compartment is spaced apart from the cation exchange membrane. The cell operates with both a low chlorine overvoltage and a low oxygen overvoltage. During electrolysis of alkali metal chloride brines, the formation of hypochlorite and chlorate ions is minimized and the alkali metal hydroxides produced have low chlorate concentrations and are suitable for use without further treatment in chlorate-sensitive applications. Spent brine treatment is simplified and at reduced costs.

7 Claims, 1 Drawing Figure

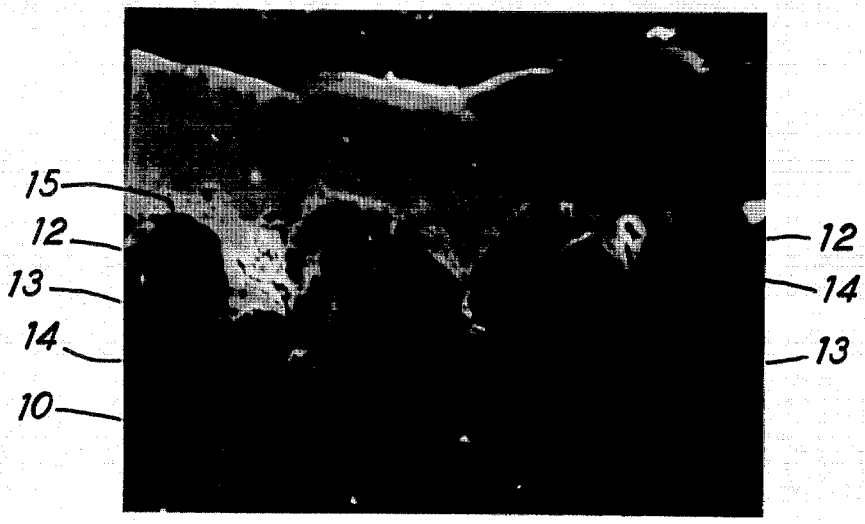
15
12
13
14
10
12
14
13

MEMBRANE ELECTROLYTIC CELL FOR MINIMIZING HYPOCHLORITE AND CHLORATE FORMATION

This invention relates to electrolytic cells for the electrolysis of alkali metal chloride brines for the production of chlorine and alkali metal hydroxides. More particularly, this invention relates to electrolytic cells for the electrolysis of alkali metal chloride brines employing cation exchange membranes.

Electrolytic cells for the production of chlorine and alkali metal hydroxides produce as an undesired byproduct, hypochlorite ions and chlorate ions. Hypochlorite ions are believed to be produced by the reaction of hydroxyl ions with dissolved chlorine. In membrane cells which employ a cation exchange membrane as the separator between the anode compartment and the cathode compartment, hypochlorite ion formation takes place primarily in the anode compartment where hydroxyl ions present in the alkali metal chloride brine and back migrating from the cathode compartment are believed to react with dissolved chlorine according to the following equation:

$$2OH^- + Cl_2 \rightarrow OCl^- + Cl^- + H_2O \quad (1)$$

Hypochlorite ions formed react with hypochlorous acid present to produce chlorate ions according to the following reaction:

$$2HOCl + OCl^- \rightarrow ClO_3^- + 2Cl^- + 2H^+ \quad (2)$$

The presence of hypochlorite ions in the anolyte is undesirable as it is believed that conductive coatings containing platinum group metal oxides are susceptible to attack by alkaline hypochlorites leading to an accelerated loss of the coating. Similarly, increasing concentrations of hypochlorite ions and chlorate ions are believed to reduce the life span of the cation exchange membrane. Chlorate ions produced contaminate both the anolyte and the catholyte. Excessive concentrations of chlorate in alkali metal hydroxide solutions make these solutions unsuitable for use in certain applications such as the production of specialty engineering plastics and resins and the manufacture of specialty organic chemicals such as those used in photographic applications.

Commercial operation of membrane electrolytic cells includes brine addition to and removal from the anode compartment. Brine removal from the anode compartment requires treatment to decompose or remove the hypochlorite, chlorate, and dissolved chlorine present. Both the capital costs and operating costs increase as the concentration of hypochlorite, chlorate and/or dissolved chlorine increases.

Previous methods for reducing or minimizing hypochlorite and chlorate formation include adding an acid such as hypochloric acid to the anolyte or to the brine removed from the cell; purging a portion of the recovered brine; or adding a salt of a metal such as nickel to the brine fed to the cell.

These and similar methods for preventing or reducing hypochlorite and chlorate formation add significantly to the costs of producing the desired products of electrolysis.

Thus there is need for an electrolytic cell in which the concentrations of hypochlorite and chlorate produced during brine electrolysis are minimized without increasing the capital or operating costs.

It is an object of the present invention to provide an electrolytic cell in which the formation of hypochlorite and chlorate ions is minimized.

Another object of the invention is to provide an electrolytic cell having both a low chlorine overvoltage and a low oxygen overvoltage.

A further object of the invention is to provide an electrolytic cell for the electrolysis of alkali metal chloride brine having reduced concentrations of dissolved chlorine in the anolyte.

An additional object of the present invention is to provide an electrolytic cell for the electrolysis of brine in which the pH of the anolyte is maintained highly acidic.

A still further object of the present invention is to provide an electrolytic cell having reduced costs for brine treatment.

These and other objects of the invention are accomplished in an electrolytic cell for the electrolysis of an alkali metal chloride brine comprising an anode compartment and a cathode compartment separated by a cation exchange membrane; an anode comprising an unflattened expanded structure of a valve metal selected from the group consisting of titanium, tantalum, niobium, and alloys thereof, positioned in the anode compartment, at least one side of the anode having as the electrochemically active surface an electrodeposited layer of a valve metal oxide, a plurality of cracks traversing the electrodeposited layer, a coating of a platinum metal group oxide on the electrodeposited layer and substantially filling the cracks; a cationic exchange membrane comprising a laminated structure having a first surface adapted to contact an anolyte in which the ion exchange groups are predominantly sulfonic acid groups, the first surface being in contact with the electrochemically active surface of the anode, and a second surface adapted to contact a catholyte in which the ion exchange groups are predominantly carboxylic acid groups, and a cathode positioned in the cathode compartment and spaced apart from the cation exchange membrane.

More in detail the novel electrolytic cell of the present invention employs as an anode an expanded metal structure of a valve metal selected from the group consisting of titanium, tantalum, or niobium or alloys of these metals. The expanded metal structure is not flattened or pressed into a flattened surface, but is used as formed during the expansion process and is thus unflattened. Preferred as valve metals for the expanded metal anode are titanium, tantalum, and their alloys. The anode has an electrochemically active surface on at least one side of the expanded metal structures. The electrochemically active surface is comprised of a porous layer of a valve metal oxide such as titanium oxide which is electrodeposited on the valve metal substrate. The porous electrodeposited valve metal oxide is impregnated with a platinum metal salt and the salt formed into an oxide by a calcining process. During the formation of the electrochemically active surface, cracks are formed in the electrodeposited layer which traverse the entire layer. These cracks are subsequently substantially filled by the platinum group metal oxide. The platinum group metal oxide coating is formed by applying to the electrodeposited valve metal oxide layer a platinum metal group compound as a paint composition which can be decomposed by firing. If the valve metal substrate is niobium or an alloy based thereon, the paint coating is preferably fired in a non-oxidizing atmosphere to prevent excessive oxidation of the substrate. If the substrate is titanium or tantalum or an alloy based thereon, the paint coating is preferably fired in an oxidizing atmosphere. Additional layers of the platinum group metal oxide may be applied by painting and drying to provide a coated surface having a suitable thickness. Titanium oxide is preferred as the electrodeposited valve metal oxide with titanium being the preferred metal substrate. Preferred as platinum group metals and hence as platinum group metal oxides are ruthenium and iridium.

In order to prevent the leaching of the platinum group metal oxide from corrosive attack by the anolyte such as an alkali metal chloride brine, a chemically resistant coating of a valve metal oxide such as tantalum oxide may be applied to the platinum group metal oxide. The FIGURE is a scanning electron micrograph of a cross sectional view of an anode 10 comprised of a titanium metal substrate 11 having a porous electrodeposited layer of titanium oxide 12 thereon. Cracks 13, formed during the processing of the anode, are filled by the platinum group metal oxide 14 which also coats and impregnates the porous electrodeposited layer of titanium oxide 12. A chemically resistant coating of tantalum oxide 15 is applied to the surface of platinum group metal oxide 14.

Anodes suitable for use in the novel process of the present invention are those, for example, described in U.S. Pat. No. 4,005,003 issued Jan. 25, 1977, to J. M. Popplewell et al, the entire disclosure of which is incorporated by reference.

Membranes which can be employed in the electrolytic cell of the present invention are inert, flexible membranes having ion exchange properties and which are substantially impervious to the hydrodynamic flow of the electrolyte and the passage of gas products produced in the cell. Suitably used are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis.

Preferred as cation exchange membranes are those comprised of a blend of a fluorinated polymer which has sulfonyl functional groups and a polymer which has carboxylic acid functional groups. Membranes of this type are described in U.S. Pat. No. 4,176,215, issued Nov. 27, 1979, to C. J. Molnar et al, the entire disclosure of which is incorporated by reference. These membranes are made by blending a melt-fabricable form of a first fluorinated polymer which contains sulfonyl functional groups and a melt-fabricable form of a second fluorinated polymer which contains carboxylic functional groups.

The melt fabricable first polymer having sulfonyl functional groups is typically a polymer having a fluorinated hydrocarbon backbone chain to which are attached the functional groups or pendant side chains which in turn carry the functional groups. The pendant side chains can contain, for example, $$-\underset{\underset{R_f}{|}}{CF}-CF_2-SO_2F$$

groups wherein $R_f$ is F, Cl, or a $C_1$ to $C_{10}$ perfluoroalkyl radical. Ordinarily, the functional group in the side chains of the polymer will be present in terminal $$-O-\underset{\underset{R_f}{|}}{CF}-CF_2SO_2F$$

groups.

Examples of fluorinated polymers of this kind are disclosed in U.S. Pat. Nos. 3,282,875; 3,560,568, and 3,718,627. More specifically, the polymers can be prepared from monomers which are fluorinated or fluorine substituted vinyl compounds. The polymers are made from at least two monomers, with at least one of the monomers coming from each of the two groups, described below.

The first group is fluorinated vinyl compounds such as vinyl fluoride, hexafluoropropylene, vinylidene fluoride, trifluoroethylene, chlorotrifluoroethylene, perfluoro(alkyl vinyl ether), tetrafluoroethylene, and mixtures thereof. In the case of copolymers which will be used in electrolysis of brine, the precursor vinyl monomer desirably will not contain hydrogen.

The second group of the sulfonyl-containing monomers containing the precursor group $$-\underset{\underset{R_f}{|}}{CF}-CF_2SO_2F,$$

wherein $R_f$ is as defined above. Additional examples can be represented by the general formula $CF_2{=}CF-T-k-CF_2SO_2F$ wherein T is a bifunctional fluorinated radical comprising 1 to 8 carbon atoms, and k is 0 or 1. Substituent atoms in T include fluorine, chlorine, or hydrogen, although generally hydrogen will be excluded in use of the copolymer for ion exchange in a chloralkali cell. The most preferred polymers are free of both hydrogen and chlorine attached to carbon, i.e., they are perfluorinated, for greatest stability in harsh environments. The T radical of the formula above can be either branched or unbranched, i.e., straight-chain and can have one or more ether linkages. It is preferred that the vinyl radical in this group of sulfonyl fluoride containing comonomers be joined to the T group through an ether linkage, i.e., that the comonomer be of the formula $CF_2{=}CF-O-T-CF_2-SO_2F$. Illustrative of such sulfonyl fluoride containing comonomers are $$CF_2{=}CFOCF_2CF_2SO_2F,\ CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

-continued $$CF_2{=}CFCF_2CF_2SO_2F, \text{ and } CF_2{=}CFOCF_2\underset{\underset{\underset{\underset{CF_3}{|}}{O}}{|}}{\underset{|}{CF_2}}CFOCF_2CF_2SO_2F.$$

The most preferred sulfonyl fluoride containing comonomer is perfluoro(3,6-dioxa-4-methyl-7-octenesulfonyl fluoride), $$CF_2{=}CFOCF_2\underset{\underset{CF_3}{|}}{CF}OCF_2CF_2SO_2F.$$

The sulfonyl-containing monomers are disclosed in such references as U.S. Pat. Nos. 3,282,875; 3,041,317; 3,718,627; and 3,560,568.

A preferred class of such polymers is represented by polymers having the repeating units $$\left[CX_2-CX_2\right]_m\left[\begin{array}{l} CF-CF_2 \\ | \\ O \\ | \\ CF_2 \\ | \\ CF-Y \\ | \quad p \\ O \\ | \\ CF-R_f \\ | \\ CF_2 \\ | \\ SO_2F \end{array}\right]_n$$

wherein m is 3 to 15;

n is 1 to 10, p is 0, 1 or 2, the X's taken together are four fluorine or three fluorines and one chlorine, Y is F or $CF_3$, and $R_f$ is F, Cl or a $C_1$ to $C_{10}$ perfluoroalkyl radical.

The most preferred copolymer is a copolymer of tetrafluoroethylene and perfluoro(3,6-dioxa-4-methyl-7-octenesulfonyl fluoride) which comprises 20 to 65 percent, preferably, 25 to 50 percent by weight of the latter.

The melt-fabricable second polymer having carboxylic functional groups is typically a polymer having a fluorinated hydrocarbon backbone chain to which are attached the functional groups or pendant side chains which in turn carry the functional groups. The pendant side chains can contain, for example, $$-\left(\begin{array}{c} CF \\ | \\ Z \end{array}\right)_t-W$$

groups wherein Z is F or $CF_3$, t is 1 to 12, and W is —COOR or —CN, where R is lower alkyl. Ordinarily, the functional group in the side chains of the polymer will be present in terminal $$-O-\left(\begin{array}{c} CF \\ | \\ Z \end{array}\right)_t-W$$

groups. Examples of fluorinated polymers of this kind are disclosed in British Pat. No. 1,145,445 and U.S. Pat. No. 3,506,635. More specifically, the polymers can be prepared from monomers which are fluorinated or fluorine substituted vinyl compounds. The polymers are usually made from at least two monomers. At least one monomer is a fluorinated vinyl compound from the first group described hereinabove in reference to polymers containing $-SO_2F$ groups. Additionally, at least one monomer is a fluorinated monomer which contains a group which can be hydrolyzed to a carboxylic acid group, e.g., a carboalkoxyl or nitrile group, in a side chain as set forth above. Again in this case, as in the case of the polymers having $-SO_2F$ groups, the monomers, with the exception of the R group in the —COOR, will preferably not contain hydrogen, especially if the polymer blend will be used in the electrolysis of brine, and for greatest stability in harsh environments most preferably will be free of both hydrogen and chlorine, i.e., will be perfluorinated; the R group need not be fluorinated as it is lost during hydrolysis when the functional groups are converted to ion exchange groups.

One exemplary suitable type of carboxyl-containing monomer is represented by the formula $$CF_2{=}CF\left(OCF_2\underset{\underset{Y}{|}}{CF}\right)_sOCF_2-COOR$$

wherein

R is lower alkyl,

Y is F or $CF_3$, and s is 0, 1 or 2.

Those monomers wherein s is 1 are preferred because their preparation and isolation in good yield is more easily accomplished than when s is 0 or 2. The compound $$CF_2{=}CFOCF_2\underset{\underset{CF_3}{|}}{CF}OCF_2COOCH_3$$

is an especially useful monomer. Such monomers can be prepared, for example, from compounds having the formula $$CF_2{=}CF\left(OCF_2\underset{\underset{Y}{|}}{CF}\right)_sOCF_2CF_2SO_2F$$

wherein s and y are as defined above, by (1) saturating the terminal vinyl group with chlorine to protect it in subsequent steps by converting it to a $CF_2Cl$—CFCl— group; (2) oxidation with nitrogen dioxide to convert the $-OCF_2CF_2SO_2F$ group to an $-OCF_2COF$ group; (3) esterification with an alcohol such as methanol to form an $-OCF_2COOCH_3$ group; and (4) dechlorination with zinc dust to regenerate the terminal $CF_2{=}CF-$ group. It is also possible to replace steps (2) and (3) of this sequence by the steps (a) reduction of the $-OCF_2CF_2SO_2F$ group to a sulfinic acid, $-OCF_2CF_2SO_2H$, or alkali metal or alkaline earth metal salt thereof by treatment with a sulfite salt or hydrazine (b) oxidation of the sulfinic acid or salt thereof with oxygen or chromic acid, whereby $-OCF_2COOH$ groups or metal salts thereof are formed; and (c) esterification to $-OCF_2COOCH_3$ by known methods.

A preferred class of carboxyl-containing polymers is represented by polymers having the repeating units

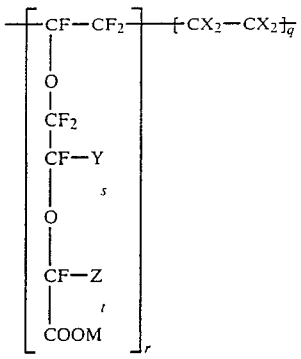

where q is 3 to 15, r is 1 to 10, s is 0, 1, or 2, t is 2, the X's taken together are four fluorines or three fluorines and one chlorine, Y is F or $CF_3$, Z is F or $CF_3$, and M is H or alkali metal.

The first and second polymers are blended by techniques familiar in the art. Powders, granules, or pellets of the individual polymers can first be mixed together. Such a mixture is then subjected to heat and pressure by various means, such as pressing, extruding in a screw extruder, or working on a roll mill or rubber mill. To assure formation of an intimate, uniform blend, the steps can be repeated two or more times. For example, pressed films can be flaked or cut into small pieces and repressed into film. Extruded polymer can be chopped into pellets as it is extruded, and then reextruded. Powders for blending can be made by grinding in a mill; cold grinding in a freezer mill is a useful technique.

Suitable polymer blends include those having at least 1 percent by weight, preferably 10 percent by weight, and most preferably 25 percent by weight of at least one first fluorinated polymer which contains sulfonyl groups, and complementally up to 99 percent by weight, preferably up to 90 percent by weight, and most preferably up to 75 percent by weight of at least one second fluorinated polymer which contains carboxylic functional groups. A blend of about 50 percent by weight of each component is highly useful.

The blends of the first and second polymers in melt-fabricable form are fabricated into film and membranes by techniques well known in the art, such as melt pressing and extrusion. Temperatures and pressures will vary depending on the polymer composition. Temperature and pressure must be high enough to provide a coalesced tough film free of holes, but not so high as to cause polymer decomposition. Fabrication temperatures of about 150° C. to 350° C. are generally required, and for many of the polymers 180° C. to 290° C. is preferred. Pressures can range from a few kilograms to many thousands of kilograms.

When the polymer is in the form of a film, desirable thickness of the order of 0.025 to 0.5 mm (0.001 to 0.02 inch) are ordinarily used. Excessive film thicknesses will aid in obtaining higher strength, but with the result deficiency of increased electrical resistance.

The term "membrane" refers to nonporous structures for separating compartments of an electrolysis cell and which may have layers of different materials, formed, for example, by surface modification of films or by lamination, and to structures having as one layer a support, such as a fabric imbedded therein.

The reinforcement fabric for encapsulation within the membrane can be either woven or nonwoven, although a woven fabric is preferred. The individual fibers of the fabric should be able to withstand a temperature from about 240° C. to about 320° C., since these temperatures are employed in the laminating steps. With this proviso, the individual reinforcing fibers can be made from conventional materials, since their main purpose is to strengthen the membrane. Due to chemical inertness, reinforcement materials made from perfluorinated polymers have been found to be preferred. The polymers include those made from tetrafluoroethylene and copolymers of tetrafluoroethylene with hexafluoropropylene and perfluoro(alkyl vinyl ethers) with alkyl being 1 to 10 carbon atoms such as perfluoro(propyl vinyl ether). An example of a most preferred reinforcement material is polytetrafluoroethylene. Supporting fibers made from chlorotrifluoroethylene polymers are also useful. Other suitable reinforcing materials include quartz and glass. Such reinforcement fibers and their use to strengthen polymers in a membrane are well known in the prior art.

As the cathode, the electrode surface is suitably a metal screen or mesh where the metal is, for example, iron, steel, nickel, or tantalum, with nickel being preferred. If desired, at least a portion of the cathode surface may be coated with a catalytic coating such as Raney nickel or a platinum group metal, oxide, or alloy as defined above.

As a preferred embodiment, the cathode has a Raney-type nickel catalytic surface predominantly derived from an adherent Beta phase ($NiAl_3$) crystalline precursory outer portion of the metal core, as described in U.S. Pat. No. 4,240,895, issued Dec. 23, 1980, to T. J. Gray. The precursory outer portion preferably has molybdenum added to give a precursor alloy having the formula $Ni_xMo_{1-x}Al_3$ where x is in the range of from about 0.75 to about 0.99 weight percent and preferably from about 0.80 to about 0.95.

Cathodes having a Beta phase Raney nickel catalytic coating have been found to exhibit very low cathode polarization values (hydrogen overvoltages) when used in the membrane electrolytic cell of the present invention for the electrolysis of alkali metal chloride brines. Thus in a monopolar membrane electrolytic cell in which an aqueous solution containing 24–26 weight percent of NaCl was electrolyzed at a cathode current density of 3 kiloamps per square meter of cathode surface while maintaining the cell temperature at 90° C. and the catholyte concentration at 33 weight percent of NaOH, the hydrogen overvoltage of a Beta phase Raney nickel alloy containing 12 percent by weight of molybdenum over a 100 day period remained constant at 120 millivolts. Under identical conditions, mild steel had a hydrogen overvoltage of 320 millivolts.

Cathodes having catalytic coatings which are predominantly Beta phase Raney nickel are prepared by a process wherein an interdiffused nickel-aluminum alloy layer is formed, from which aluminum is subsequently selectively leached. The process includes the steps of (a) preparing a metallic core with a nickel-bearing outer layer, (b) aluminizing the surface of the core, (c) interdiffusing the aluminum and nickel, (d) selectively leaching aluminum from the inter-diffused material, (e) optionally chemically treating to prevent potential pyrophoricity and (f) optionally coating with nickel to improve the mechanical properties of the final surface.

The metallic core which comprises the starting material for the electrode is prepared to have a nickel-bearing outer layer in which the nickel concentration is at least 15 percent, and preferably at least 18 percent by weight. When the core is of substantially pure nickel or an appropriate nickel-bearing alloy such as Inconel 600, Hastelloy C or 310 Stainless Steel, the core inherently has the desired nickel-bearing outer layer.

For cores of other metals or alloys, a nickel coating can be deposited on the core by known techniques, such as metal dipping, electroplating, electroless plating and the like. The nickel-bearing outer layer of the core, whether provided by the core metal itself or as a deposited coating, is conveniently at least 100 microns thick, and preferably at least 150 microns thick. The maximum thickness of the nickel-bearing outer layer is a matter of convenience and economic choice. Although cores in the form of screens or plates and especially screens are preferred, cores made from foils, wires, tubes or expanded metal are also suitable.

The cation exchange membranes, for example, in sheet form, are placed between each anode and cathode to form separate anode and cathode compartments. The membranes are held in place between adjacent anodes and cathodes using appropriate holding means and sealing means.

To minimize the formation of hypochlorite ions and chlorate ions and permit the cell to operate at reduced cell voltages, the electrochemically active surface of the unflattened expanded metal anode is placed in direct contact with the cation exchange membrane.

Any suitable means may be used to assure contact of the cation exchange membrane with the coated anode surface including pressure means such as hydraulic pressure or gas pressure or mechanical means such as spacers and the like. In a preferred embodiment, the membrane is maintained in contact with the anode surface by a hydraulic pressure differential obtained by maintaining the electrolyte in the cathode compartment at a higher level than that of the electrolyte in the anode compartment. A suitable process is that described in U.S. Pat. No. Re. 30,864, issued Feb. 9, 1982, to D. J. Justice et al. In this process, differential pressures for maintaining the membrane in contact with the anode surface are defined such that the hydrostatic pressure of the catholyte plus the gas pressure over the catholyte minus the hydrostatic pressure of the anolyte minus the gas pressure over the anolyte is from about 0.01 to about 25 inches when the solution in the cathode chamber corresponds to a gas-free solution having specific gravities from about 1.05 to about 1.55 and the solution in the anode chamber corresponds to a gas-free solution having specific gravities of 1.08 to 1.20. Preferred differential pressures are those from about 5 to about 25 and more preferred pressures are those from about 10 to about 25 inches.

In this embodiment, the space between the membrane and the cathode is maintained at from about 0.1 to about 15 and preferably from about 0.5 to about 6 millimeters.

It is surprising that the electrolytic cell of the present invention minimizes hypochlorite and chlorate formation under pressure conditions which would seem to promote back migration of hydroxyl ions from the cathode compartment to the anode compartment.

The exact mechanism by which the novel membrane electrolytic cell employing the combination of an unflattened expanded valve metal structure having as the electrochemically active surface an electrodeposited valve metal oxide coated with a platinum group metal oxide, where the electrochemically active surface is in contact with a surface of a cation exchange membrane having predominately sulfonic acid groups as the ion exchange groups minimizes the formation of hypochlorite ions and chlorate ions is not known. However, it is believed, though not wishing to be bound by theory, that the combination permits the rapid release of chlorine gas formed at the interface of the unflattened expanded metal anode and the membrane which minimizes the dissolving of chlorine gas in the anolyte at the membrane-anode interface and thus reduces hypochlorite ion formation. The combination is further believed to provide a low oxygen overvoltage which results in the production of small amounts of oxygen gas and hydrogen ions. The hydrogen ions maintain the acidity of the anolyte at low levels which further minimizes the dissolving of chlorine gas. Lower concentrations of hypochlorite ion produced results in reduced concentrations of chlorate ions.

The novel electrolytic membrane cell of the present invention can be any suitable type of cell such as a monopolar or bipolar cell. The preferred cell structure is a monopolar filter press membrane cell such as those described in U.S. Pat. No. 4,056,458, issued Nov. 1, 1977, to G. R. Pohto et al; U.S. Pat. No. 4,210,516, issued July 1, 1980, to L. Mose et al and U.S. Pat. No. 4,217,199, issued Aug. 12, 1980, to H. Cunningham.

In these monopolar filter press membrane cells, the anodes and cathodes are arranged in alternating sequence. The term "anode" or "cathode" is intended to describe the entire electrode unit which is comprised of a frame which encases the periphery of the appropriate electrode and on opposing sides has a pair of anodic or cathodic surfaces, as disclosed above, attached thereto. The space within the individual electrode between the electrode surfaces comprises the major portion of the compartment through which the anolyte or catholyte fluid, as appropriate, passes during the electrolytic process. The particular electrode compartment is defined by a pair of membranes that are placed adjacent to, but exteriorly of the opposing electrode surfaces, thereby including the opposing electrode surfaces within each compartment. The term "anode" or "cathode" is further intended to encompass the electrical current conductor rods that pass the current through the appropriate electrode, as well as any other elements that comprise the entire electrode unit.

The novel membrane electrolytic cell of the present invention is suitably used in the electrolysis of aqueous solutions of alkali metal chlorides in the production of chlorine gas and alkali metal hydroxides. Preferred as alkali metal hydroxides are sodium chloride and potassium chloride, with sodium chloride being particularly preferred. Employing the novel membrane electrolytic cell, water or an aqueous solution of sodium hydroxide is provided to the cathode compartment in amounts sufficient to apply the required differential pressure from the cathode compartment to the anode compartment to maintain contact between the membrane and the anode surface. Sodium chloride brines having a weight concentration of NaCl in the range of from about 100 to about 325 and preferably from about 200 to about 305 grams per liter are employed. The brines fed to the anode compartment may be acidic, neutral or basic, having a pH in the range of from about 1.0 to about 12.0. Brines entering the cell are essentially deplete of hypochlorite ions, but have a residual concentration of chlorate ions which varies with the degree and method of treatment of the spent brine recovered from the cell. During electrolysis in the novel cell of the present invention, the hypochlorite ion concentration produced in the anode compartment is less than about 0.5 grams per liter and normally less than 0.2 grams per liter. This concentration is determined, for example, by direct measurement of hypochlorite ions in the spent brine recovered from the anode compartment.

As a result of the low concentration of hypochlorite ions produced in the anode compartment, the concentration of chlorate ions produced is also minimized, their concentration being less than about 1.0 grams per liter and normally in the range of from about 0.7 to about 0.9 grams per liter.

Chlorate ion concentration produced in the anode compartment is determined from measurements of the brine flow rate and the chlorate concentration in the brine at the inlet to the cell and the spent brine flow rate and the chlorate concentration in the spent brine at the outlet of the anode compartment.

Spent brine removed from the anode compartment for resaturation remains highly acid. For example, where the brine fed to the novel cell of the present invention initially had an acidic pH in the range of from about 1.5 to about 4.0, the pH of the depleted brine removed from the cell is below about 3, i.e., in the range of from about 1.0 to about 2.5. Where alkaline brines having initially a pH in the range of from about 9.0 to about 12.0 are fed to the cell, depleted brines recovered from the anode compartment have a pH of less than about 4, for example, in the range of from about 1.5 to about 3.5. In addition, the novel membrane electrolytic cell operates at surprisingly low cell voltages to produce, for example, chlorine and sodium hydroxide at high current efficiencies where the sodium hydroxide concentration is in the range of from about 300 to about 800 and preferably from about 400 to about 700 grams per liter.

Brine removed from the anode compartment has a reduced concentration of sodium chloride which is from about 40 to about 80 percent below that fed to the anode compartment as fresh brine. Because of the low chlorate ion concentration in depleted brine recovered from the novel cell of the present invention there is no need to further treat the brine or purge a portion of the brine to remove or reduce chlorate ions. Thus the treatment of depleted brine with an acid such as hydrochloric acid, a method commonly used to reduce chlorate ion and liberate dissolved chlorine, can be completely eliminated. Where the hypochlorite ion concentration in depleted brine is about 0.2 grams per liter or lower, no treatment of the depleted brine is required prior to resaturation by the addition of salt. For depleted brines having a hypochlorite ion concentration in the range of from about 0.2 to about 0.5 gram, flash evaporation of a portion of the depleted brine or the addition of a reducing agent such as sodium thiosulfate may be required.

Alkali metal hydroxides produced in the novel membrane electrolytic cell of the present invention have chlorate ion concentrations below about 10 parts per million and preferably below about 3 parts per million. No additional treatment of the alkali metal hydroxides is required to reduce chlorate ion concentrations even when employed in the manufacture of specialty engineering plastics and resins or the production of specialty organic chemicals for photographic applications.

To further illustrate the novel membrane electrolytic cell of the present invention, the following examples are presented without any intention of being limited thereby. All parts and percentages are by weight unless otherwise specified.

EXAMPLE 1

Sodium chloride brine (292 gpl) was fed to the anode compartment of a filter press monopolar membrane electrolytic cell having a cation exchange membrane separating the anode compartment from the adjacent cathode compartment. The membrane was comprised of a melt-fabricated structure containing two perfluorinated polyolefin films encapsulating a polytetrafluoroethylene fabric. One perfluorinated polyolefin film contained a preponderance of sulfonyl functional groups and faced the anode. The second perfluorinated polyolefin film contained a preponderance of carboxylic functional groups and faced the cathodes. The anode was a titanium expanded metal structure having a coating of the type of the FIGURE which included an electrodeposited layer of titanium oxide on the titanium base and an electroconductive layer of ruthenium oxide which penetrated and filled cracks formed during the processing of the anode. The cathode was comprised of a nickel mesh having a catalytic coating of a predominately Beta phase Raney nickel-molybdenum alloy containing 15 percent by weight of Mo. Initially, an aqueous solution containing 32 percent by weight of NaOH was fed to the cathode compartment. The catholyte was maintained at a level above the level of the anolyte which provided differential pressure in the range of 0.03 to 64 centimeters which forced the membrane against the anode surface to substantially eliminate any membrane-anode gap. The catholyte level was maintained by controlling in combination the rate of addition of water to the cathode compartment and the rate of removal of caustic soda solution from the cathode compartment. The cathode to membrane gap was about 4 millimeters. The cell was operated for a period of 64 days at a current density of 2.0 kiloamps per square meter while maintaining the cell temperature in the range of 85°-90° C. The pH of the sodium chloride brine fed to the cell was in the range of 1.8 to 5.5 for 32 days and at a pH in the range of 9.1 to 11.5 for 32 days.

Sodium chloride spent brine was continuously removed from the cell and analyzed for the concentration of hypochlorite ion, chlorate ion and dissolved chlorine present. During the period of operation, hypochlorite ion was produced at a concentration in the range of 0.08 to 0.39 grams per liter with an average concentration of 0.19 grams per liter. Chlorate ion was produced as a concentration in the spent brine to a maximum of 0.4 grams per liter, with an average concentration of 0.2 grams per liter. The pH of the spent brine was in the range of 1.5 to 3.3.

Caustic soda containing 32.5 percent by weight of NaOH was produced at cell voltages in the range of 3.48–3.59 volts and cathode current efficiencies in the range of 94–99 percent. The power consumption ranged from 2340 to 2640 kilowatt hours per metric ton of NaOH.

COMPARATIVE EXAMPLE A

The filter press monopolar electrolytic cell of EXAMPLE 1 was equipped with flattened expanded titanium metal anodes, where the electrochemically active coating consisted of a mixture of titanium oxide and ruthernium oxide (Diamond Shamrock Corp.). Sodium chloride brine (290 gpl) and a pH in the range of 1.5 to 4.0 was fed to the cell. The membrane and cathode were identical to those used in EXAMPLE 1. The electrolysis procedure of EXAMPLE 1 was employed with the membrane spaced apart from each of the electrode surfaces where the total anode-cathode gap was 0.4 cm. The cell was operated for 82 days. Brine removed from the cell had a pH in the range of 3.8 to 4.5, and hypochlorite ion concentration produced in the range of 1.01 to 3.99 grams per liter, with the average concentration being 2.5 grams per liter. The chlorate ion concentration produced was in the range of 0.01 to 1.71 grams per liter with the average concentration being 0.36 grams per liter. During the period of operation, the catholyte produced contained 33.0 percent by weight of NaOH at a cell voltage in the range of 3.90 to 4.10 volts and current efficiencies in the range of 92.0 to 97.0 percent. Power consumption was in the range of 2722 to 2902 KWH per metric ton of NaOH.

What is claimed is:

1. A process for electrolyzing an alkali metal chloride brine in which low concentrations of hypochlorite ion and chlorate ion are formed which comprises:

(a) feeding said alkali metal chloride brine to an electrolytic cell comprised of an anode compartment and a cathode compartment separated by a cation exchange membrane; an anode positioned in said anode compartment and in contact with said alkali metal chloride brine, said anode comprised of an unflattened expanded structure of a valve metal selected from the group consisting of titanium, tantalum, niobium, and alloys thereof, at least one side of said anode having as the electrochemically active surface an electrodeposited layer of a valve metal oxide, a plurality of cracks traversing said electrodeposited layer, a coating of a platinum metal group oxide on said electrodeposited layer and substantially filling the cracks; said cationic exchange membrane comprised of a laminated structure having a first surface in contact with said alkali metal chloride brine in which the ion exchange groups are predominately sulfonic acid groups, the first surface being in contact with the electrochemically active surface of said anode, and a second surface contacting a catholyte in which the ion exchange groups are predominately carboxylic acid groups, and a cathode positioned in the cathode compartment and spaced apart from the cation exchange membrane;

(b) electrolyzing said alkali metal chloride brine to produce in said anode compartment chlorine gas;

(c) recovering from said anode compartment chlorine gas and spent alkali metal chloride brine, said spent alkali metal chloride brine having a hypochlorite ion concentration of less than about 0.5 grams per liter.

2. The process of claim 1 in which said catholyte is an alkali metal hydroxide.

3. The process of claim 2 in which the pH of said alkali metal chloride brine fed to said electrolytic cell is in the range of from about 1 to about 12.

4. The process of claim 3 in which said alkali metal chloride brine is sodium chloride.

5. The process of claim 4 in which said contact between said coated surface of said anodes and said cation exchange membrane is provided by maintaining a positive differential pressure between said catholyte in said cathode compartment and said alkali metal brine in said anode compartment of from about 0.01 to about 25 inches.

6. The process of claim 5 in which said cation exchange membrane is comprised of a blend of 10 to 90 percent by weight of a first fluorinated polymer which has repeating units

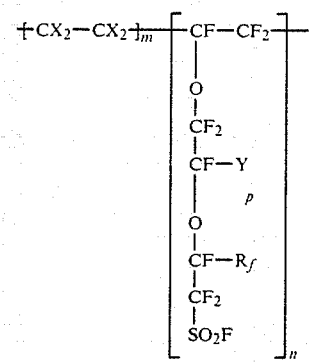

where m is 3 to 15, n is 1 to 10, p is 0, 1, or 2, the X's taken together are four fluorines or three fluorines and one chlorine, Y is F or $CF_3$, $R_f$ is F, Cl, or a $C_1$ to $C_{10}$ perfluoroalkyl radical, and 90 to 10 percent by weight of a second fluorinated polymer which has repeating units

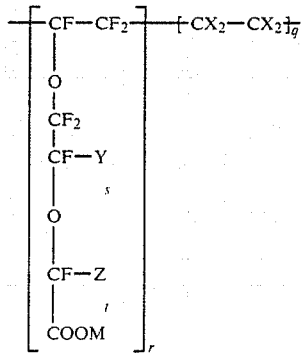

where q is 3 to 15, r is 1 to 10, s is 0, 1, or 2, t is 2, the X's taken together are four fluorines or three fluorines and one chlorine, Y is F or $CF_3$, Z is F or $CF_3$, and M is H or alkali metal.

7. A process for electrolyzing an alkali metal chloride brine in which low concentrations of hypochlorite ion and chlorate ion are formed which comprises:

(a) feeding said alkali metal chloride brine to an electrolytic cell comprised of an anode compartment and a cathode compartment separated by a cation exchange membrane; an anode positioned in said anode compartment and in contact with said alkali metal chloride brine, said anode comprised of an unflattened expanded structure of a valve metal selected from the group consisting of titanium, tantalum, niobium, and alloys thereof, at least one side of said anode having as the electrochemically active surface an electrodeposited layer of a valve metal oxide, a plurality of cracks traversing said electrodeposited layer, a coating of a platinum metal group oxide on said electrodeposited layer and substantially filling the cracks; said cationic exchange membrane comprised of a laminated structure having a first surface in contact with said alkali metal chloride brine in which the ion exchange groups are predominately sulfonic acid groups, the first surface being in contact with the electrochemically active surface of said anode, and a second surface contacting a catholyte in which the ion exchange groups are predominately carboxylic acid groups, and a cathode positioned in the cathode compartment and spaced apart from the cation exchange membrane, said contact between said coated surface of said anodes and said cation exchange membrane being provided by maintaining a positive differential pressure between said catholyte in said cathode compartment and said alkali metal brine in said anode compartment of from about 0.01 to about 25 inches;

(b) electrolyzing said alkali metal chloride brine to produce in said anode compartment chlorine gas; and (c) recovering from said anode compartment chlorine gas and spent alkali metal chloride brine, said spent alakali metal chloride brine having a hypochlorite ion concentration of less than about 0.5 grams per liter.

* * * * *